United States Patent [19]

Knopf

[11] 4,380,306

[45] Apr. 19, 1983

[54] SMALL BEER CONTAINER

[75] Inventor: Klara Knopf, Cologne, Fed. Rep. of Germany

[73] Assignee: Karl Horst Knopf, Solingen, Fed. Rep. of Germany

[21] Appl. No.: 234,097

[22] Filed: Feb. 12, 1981

[30] Foreign Application Priority Data

Jun. 4, 1980 [DE] Fed. Rep. of Germany ..... 3021057

[51] Int. Cl.[3] ..... B65D 83/00; F37L 37/18

[52] U.S. Cl. ..... 222/89; 222/400.7; 220/70

[58] Field of Search ..... 220/66, 70, 288, 293, 220/301; 222/400.7, 400.8, 401, 91, 82, 89

[56] References Cited

U.S. PATENT DOCUMENTS

| | | | |
|---|---|---|---|
| 3,327,899 | 6/1967 | Reynolds et al. | 222/400.7 X |
| 3,381,845 | 5/1968 | MacDonald | 220/301 |
| 3,823,848 | 7/1974 | Schuster et al. | 222/400.7 X |
| 3,827,595 | 8/1974 | Reynolds | 220/1 R |

FOREIGN PATENT DOCUMENTS

| | | | |
|---|---|---|---|
| 1939025 | 2/1966 | Fed. Rep. of Germany . | |
| 1916390 | 10/1970 | Fed. Rep. of Germany | 222/400.7 |
| 2502192 | 7/1976 | Fed. Rep. of Germany | 222/400.7 |

*Primary Examiner*—David A. Scherbel

*Attorney, Agent, or Firm*—Schwartz, Jeffery, Schwaab, Mack, Blumenthal & Koch

[57] ABSTRACT

A blow-molded synthetic plastic beer container has a narrow neck and cover mounted in gas-tight relationship thereto. A rubber stopper is positioned in the cover and extends into the neck. The cover has a pair of opposingly projecting arms, with reinforcing ribs thereunder, receiving the attachment of a tap fitting which includes opposingly projecting fastening stirrups cooperating with the projecting arms. The cover further includes a depression therein in the center of the top thereof, the depression having a relatively thin-walled bottom with a hole therein, and the rubber stopper has a circumferential groove therein positioned in the hole.

5 Claims, 4 Drawing Figures

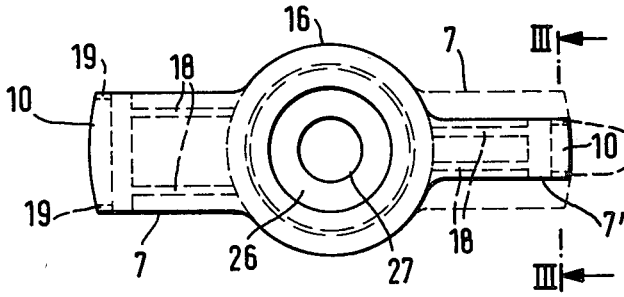
FIG. 2
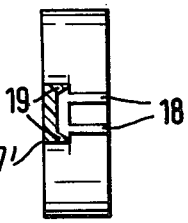
FIG. 3
FIG. 4
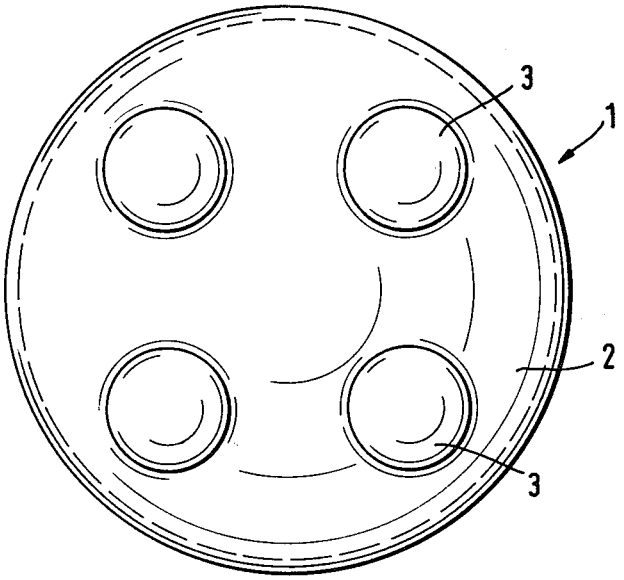

SMALL BEER CONTAINER

BACKGROUND

1. Field of the Invention

The invention relates to small containers for beer and in particular small containers that may be used as table containers for the tapping of beer in homes, at parties and on similar occasions.

2. Prior Art

Large tin plated cans of the type used for food preservation to hold beer having a percent alcohol approximately 3.5 to 5.1 are known for this purpose. Such cans are essentially cylindrical and have flat tops and bottoms beaded on the cylindrical circumference. A rubber stopper placed in the center of the top is penetrated by a pointed descending pipe of the tap fitting during the tapping of the small container. The tap fitting has a small carbon dioxide cartridge providing pressure to drive the beer upward through the descending pipe and causing it to flow from the spigot upon actuation thereof. The tap fitting is secured to the can by means of two projecting fastener stirrups located opposite each other and extending on the sides past the top of the can. The stirrups may be fixedly attached to the beaded rim of the can by means of hook-like extensions provided at the ends. Tap fittings of this type remain with the user, while the cans are discarded after use. These tap fittings are found in large numbers in the possession of the public.

The fact that the cans must be discarded after use represents a problem because of their price. Furthermore, they are bulky and do not deteriorate so that they also constitute a substantial environmental problem.

Because of the difficulty of being hygienically cleaned through the narrow hole provided for the rubber stopper, the refilling of the cans is not feasible.

OBJECTS AND SUMMARY

It is the object of the invention to provide a reusable small container for beer, whereby existing tap fittings may be utilized.

According to the invention this object is accomplished by providing a small blow-molded plastic container restricted on top to form a neck, a cover to fit the neck in a gas tight manner, a rubber stopper arranged within the neck and with the latter being equipped with opposing and projecting arms for the attachment of tap fittings carrying opposing and projecting fastening stirrups.

The manufacture of the small container from a synthetic plastic material results fundamentally in less hygiene problems because of the chemical stability of the material. Furthermore, a blow-molded plastic container has, by virtue of the characteristics of the production method, a shape that is rounded on all sides. Thus, there are no corners wherein residue can accumulate, such as in the case of the inner rims of the known metal cans, creating a condition that prevents reuse. The opening in the container made of a synthetic plastic material may be made larger than the opening in the top of a metal can so that the cleaning process if facilitated.

The blow molding of the plastic container not only offers more favorable conditions for cleaning, but also results in a method that has cost advantages if such a plastic container is to compete with the known metal cans. On the other hand, the method imposes a restriction with respect to design because it is difficult to provide on the neck fastening means in the form of projecting protrusions, or the like, to which the tap fitting may be attached. For this reason, the invention provides a cover which carries the rubber stopper and the opposing, projecting arms which serve to hold the tap fitting. The cover may be made in a simple manner by pressure or injection molding. By assigning to the cover the function of holding, the plastic container itself may be left in the simplest form that is most suitable for manufacture by blow molding.

In the preferred embodiment, the neck is threaded with circumferential threading onto which the cover may be screwed by means of a threaded sleeve provided thereon.

In order to create a surface similar to the flat top side of the metal cans for which the tap fittings are designed, it is advisable to locate the arms with their top surface in a plane that is perpendicular to the axis of the neck. They may be in the shape of small plates with reinforcing ribs projecting from the plastic container and being connected at their inner end with the threaded sleeve part.

For the attachment of the rubber stopper, the cover may be equipped in the center of its top side with a depression having a relatively thin bottom and containing a hole in the rim of which the rubber stopper is fastened by means of a circumferential groove.

BRIEF DESCRIPTION OF THE DRAWINGS

The above and other objects and advantages will be appreciated from the following description and accompanying drawings wherein:

FIG. 2 is a top sectional view of the small container taken along II—II in FIG. 1;

FIG. 3 is a cross-section view taken along line III—III in FIG. 2; and

FIG. 4 is a bottom view of the small container according to FIG. 1.

DETAILED DESCRIPTION OF THE INVENTION

Figure 1:
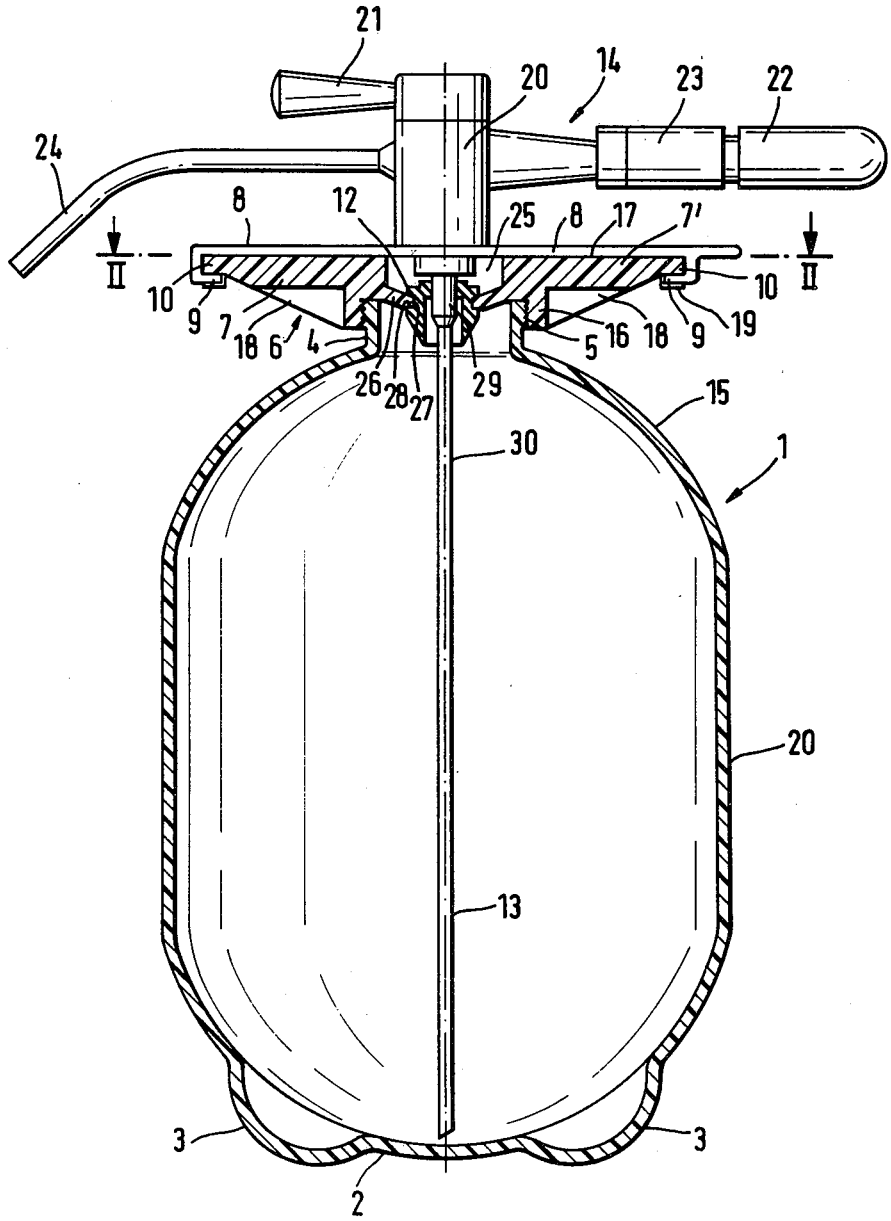
FIG. 1 is a side view partially in cross-section, of a small container equipped with a tap fitting according to the invention.

A synthetic plastic container forming the small container of the invention is designated in its entirety by numeral 1. It is produced by blow molding and has a generally cylindrical center portion 20, having at its topmost end in FIG. 1 a generally hemispherical cap 15 and at its lower end a generally hemispherical cap 2, equipped with a plurality of hollow feet 3, which in the example of the instant embodiment (see FIG. 4) are located at the corners of a square.

In the crest of the cap 15 the plastic container 1 is joined together in a threaded neck 4 carrying on its outer circumference a plurality of threads 5, which projects in the form of a connecting piece from the cap 15 as seen in FIG. 1.

The threaded neck 4 receives a threaded cover designated in its entirety by 6. The cover 6 comprises a threaded sleeve part 16 cooperating with the outer threading 5 of the threaded neck 4. On the cover 6, opposing, projecting arms 7 and 7' are provided in the form of small plates, located with their top surfaces 17 in a common plate perpendicular to an axis 30 of the threaded neck and the cylindrical part 20. The widths of the arms 7 and 7' may be identical, as indicated in FIG.

2, but arms 7 and 7′ having different widths may also be used. This depends on the configuration of the tap fitting for which the small container or the cover 6 is primarily intended.

A plurality of reinforcing ribs 18 are provided on the lower side of the arms 7 facing the plastic container 1, the reinforcing ribs being connected at their inner ends to the threaded sleeve part 16. At the outer edge of the arms, projections 19 are provided on both sides, opposing each other in the circumferential direction and projecting toward the side facing away from the top side 17. The fastening stirrups 8 of the tap fitting extend between the projections 19, which prevent the lateral slipping of the fastening stirrups 8, especially at the narrower arm 7′.

The tap fitting, designated in its entirety by 14, comprises a valve 20 which may be actuated by a handle 21 rotatable around the axis 30. The tap pressure is provided by a carbon dioxide cartridge arranged in a screw cap 22 and opened by the screwing of the screw cap 22 into a domed part 23. The gaseous carbon dioxide passes through internal conduits, not shown, of the tap fitting 14 into the inner space of the plastic container 1 and pressurizes the beer through the descending pipe 13 in the upward direction, from where it flows through valve 20 opened by the rotation of the handle 21, into a discharge tube 24, where it may be dispensed.

At the bottom side of the valve 20, the two fastening stirrups 8 projecting in opposing directions are provided, the stirrups being equipped with extensions 9 bent inwardly at their ends to form hooks. Normally, tap fittings of this type are intended for the tapping of beer from large metal cans, whereby the hook-like extensions 9 grip the beaded rim of the top side of such metal cans. In the present case, however, the hook-like extensions 9 grip the protruding ends 10 of the arms 7 and 7′.

In the center of the top side of the cover 6 a depression 25 is provided, the depression having a relatively thin walled bottom 26 engaging with the rim of an inner opening 27 a circumferential groove 28 of a rubber stopper 12. The rubber stopper 12 is penetrated by the descending pipe 13 and serves to seal the descending pipe 13 and an upper part 29 against the pressure of the carbon dioxide when the tap fitting 14 is actuated.

The small container 1 is supplied with the cover 6, wherein the rubber stopper 12 is closed during transportation, thus sealing the beer in. The rubber stopper is then pierced in the course of the tapping process by the suitably sharpened descending pipe 13. If the plastic container 1 is sufficiently elastic in the area of the neck 4, gas tight sealing may be obtained between the neck 4 and the cover 6 by screwing the cover 6 in the manner of the example of the embodiment directly onto the neck 4. Obviously, however, a gasket may be provided between the area of the cover 6 involved and the top side of the neck 4.

While several embodiments of the invention have been described, it will be understood that it is capable of still further modifications and this application is intended to cover any variations, uses, or adaptations of the invention, following in general the principles of the invention and including such departures from the present disclosure as to come within knowledge or customary practice in the art to which the invention pertains, and as may be applied to the essential features hereinbefore set forth and falling within the scope of the invention or the limits of the appended claims.

What is claimed is:

1. A beer container device for use with a tap fitting having opposingly projecting fastening stirrups and a descending pipe, said device comprising:
   (a) a container of plastic material having a narrow neck at the top thereof,
   (b) a cover mounted in gas-tight relationship on said neck,
   (c) a rubber stopper being positioned in said cover and extending into said neck, said stopper being adapted to be pierced by said descending pipe,
   (d) said cover having a pair of opposingly projecting arms for receiving said opposingly projecting fastening stirrups of said tap fitting.

2. The container device as defined in claim 1 wherein said neck is threaded with circumferential threads, said cover having a sleeve with cooperating inner threads for screwing said cover on said neck.

3. The container device as defined in claim 1 or 2 wherein said projecting arms have top surfaces in a plane perpendicular to the axis of the neck.

4. The container device as defined in claim 3 wherein said projecting arms are formed of plates and have a plurality of reinforcing ribs connected to said inner sleeve.

5. A container device as defined in claim 1 or 2 wherein said cover includes a depression therein in the center of the top thereof, said depression having a relatively thin-walled bottom with a hole therein, and said rubber stopper having a circumferential groove therein positioned in said hole.

* * * * *